US005696524A

United States Patent [19]

Hoshino et al.

[11] Patent Number: 5,696,524

[45] Date of Patent: Dec. 9, 1997

[54] GRADATIVE DRIVING APPARATUS OF LIQUID CRYSTAL DISPLAY PANEL

[75] Inventors: Masafumi Hoshino; Hiroyuki Fujita; Hirotomo Oniwa; Fujio Matsu; Shuhei Yamamoto, all of Chiba, Japan

[73] Assignee: Seiko Instruments Inc., Japan

[21] Appl. No.: 437,500

[22] Filed: May 9, 1995

[30] Foreign Application Priority Data

May 18, 1994 [JP] Japan ..... 6-104150

[51] Int. Cl.[6] ..... G09G 3/36

[52] U.S. Cl. ..... 345/89; 345/87; 345/100; 345/147; 359/264

[58] Field of Search ..... 345/89, 87, 103, 345/100, 147; 359/55, 56, 264

[56] References Cited

U.S. PATENT DOCUMENTS

| | | | |
|---|---|---|---|
| 5,347,294 | 9/1994 | Usui et al. | 345/89 |
| 5,420,604 | 5/1995 | Scheffer et al. | 345/100 |
| 5,459,495 | 10/1995 | Scheffer et al. | 345/147 |
| 5,489,919 | 2/1996 | Kuwata et al. | 345/100 |
| 5,532,713 | 7/1996 | Okada et al. | 345/97 |
| 5,583,530 | 12/1996 | Mano et al. | 345/89 |

FOREIGN PATENT DOCUMENTS

| | | |
|---|---|---|
| 0507061 | 10/1992 | European Pat. Off. . |
| 0513551 | 11/1992 | European Pat. Off. . |
| 0569974 | 11/1993 | European Pat. Off. . |
| 0598913 | 6/1994 | European Pat. Off. . |
| 4031905 | 4/1991 | Germany . |

*Primary Examiner*—Raymond J. Bayerl
*Assistant Examiner*—Seth D. Vail
*Attorney, Agent, or Firm*—Adams & Wilks

[57] ABSTRACT

A display device includes a vertical driver for applying to row electrodes a set of row signals represented by a set of orthogonal functions supplied by an orthogonal function generator at each selection period by group-sequential scanning within one frame. A dot product processor successively carries out a dot product computation between the set of orthogonal functions and a set of pixel data. A horizontal driver applies to column electrodes column signals having voltage levels determined by the results of the dot product computation at each selection period in synchronization with the group-sequential scanning. A frame memory stores the pixel data for each frame in divided bit form. The dot product processor reads out the set of stored pixel data in divided bit form and executes the dot product computation to produce a column signal component for each respective bit. The horizontal driver arranges a plurality of column signal components corresponding to the respective bits subjected to either pulse modulation or frame-rate modulation within one frame period to produce the column signal that is applied to the column electrodes. A memory controller controls the writing of the pixel data into the frame memory. Bit data subjected to the pulse modulation are written to the frame memory for every frame, while bit data subjected to frame-rate modulation are selectively written to the frame memory only at frames specified by the frame-rate modulation.

2 Claims, 8 Drawing Sheets

FIG. 3

| GRADATION | FIRST BIT | SECOND BIT | THIRD BIT |
|---|---|---|---|
| 0 | 0 | 0 | 0 |
| 1 | 0 | 0 | 1 |
| 2 | 0 | 1 | 0 |
| 3 | 0 | 1 | 1 |
| 4 | 1 | 0 | 0 |
| 5 | 1 | 0 | 1 |
| 6 | 1 | 1 | 0 |
| 7 | 1 | 1 | 1 |

GRADATIVE DRIVING APPARATUS OF LIQUID CRYSTAL DISPLAY PANEL

BACKGROUND OF THE INVENTION

The present invention relates to a driving apparatus of a liquid crystal display panel of a simple matrix type using STN liquid crystal or the like. More specifically, the invention relates to the driving apparatus suitable for multi-line selection method or the like. Further specifically, the invention relates to a circuit construction of the driving apparatus applicable to a gray shading method by frame-rate-modulation.

The liquid crystal display panel of the simple matrix type has a liquid crystal layer held between a plurality of row electrodes and a plurality of column electrodes to define a matrix of pixels. Conventionally, the liquid crystal display panel is driven by voltage-averaging method. In this method, the row electrodes are sequentially selected one by one, and concurrently the column electrodes are supplied with a data signal indicative of on/off states. Consequently, each pixel is applied with a voltage such that a high voltage is applied one time (1/N time) while a constant bias voltage is applied in the remaining time ((N−1)/N) within one frame period during which all of the row electrodes (N lines) are once selected. If the liquid crystal material that is used has a relatively slow response speed, a luminance of the pixel is varied according to an effective amplitude of the applied voltage waveform within one frame period. However, if a frame frequency is lowered as a line division number is increased, a difference between the frame period and the response time of the liquid crystal becomes small so that the liquid crystal responds to each pulse applied thereto to thereby cause a flicker of the luminance called "frame response phenomenon" which would decrease a contrast.

Recently, the multi-line selection method was developed in order to solve the problem of the frame response phenomenon, as disclosed, for example, in Japanese Patent Application Laid-open No. 5-100642. In contrast to the conventional one-line selection method, the multi-line selection method has a feature in which a plurality of row electrodes are concurrently selected so as to effectively raise the frame frequency to thereby suppress the frame response phenomenon. The row electrodes are not selected one by one, but are concurrently selected in a group, which requires a specific technique for achieving a free image display. Namely, the original pixel data are processed by computation to thereby apply a column signal to the column electrode. In detail, a group of row signals represented by a set of orthogonal functions is applied to the row electrodes group-sequentially at each selection period. On the other hand, dot product computation is successively carried out between the set of the orthogonal functions and a selected set of the pixel data, and the column signals having voltage levels determined by the computation results are applied to the column electrodes during each selection period in synchronization with the group-sequential scanning.

The multi-line selection method can be extended to gray shading display. The gray shading can be realized by various modulation modes. For example, pulse modulation mode and frame-rate modulation mode are easily combined with the multi-line selection method, as taught by the Japanese Patent Application Laid-open No. 5-100642. In this method, the given pixel data has a multi-bit form to determine a gradation level. In the dot product computation between the set of the orthogonal functions and the set of the pixel data, the set of the pixel data is split into units of bit, which are then subjected to the dot product computation to produce column signal components corresponding to the respective bit units. Further, the column signal components are sequentially arranged according to order of the bit units within one selection period to form a composite column signal which is applied to the column electrodes. At this moment, each bit unit is subjected to either the pulse modulation and the frame-rate modulation to realize the gray shading display.

The pixel data are once written into a frame memory prior to the dot product computation. The frame memory is required for each dot unit of the pixel data in the gray shading display. As the gradation level is made fine and the pixel number is increased, a huge column of the frame memory is required, which would hinder practicing of the liquid crystal display panel.

Conventionally, all bits of the pixel data are written into the frame memory at every frame period. The bit of the pixel data subjected to the pulse modulation must be read out every frame to conduct the dot product computation. On the other hand, the bit subjected to the frame-rate modulation may not be required every frame. For example, in case that a half tone (½ gradation) is carried out by the frame-rate modulation, one frame is thinned Out from every of two frames. Accordingly in the prior art, the bit subjected to the frame-rate modulation is selected at a reading stage of the frame memory. However, in such a method, all bits of the pixel data are stored in the frame memory at a writing stage, which could not save the capacity of the frame memory.

SUMMARY OF THE INVENTION

In view of the above noted problem of the prior art, an object of the invention is to save a frame memory capacity in performing the gradative driving by the multi-line selection. In order to achieve the object, the invention provides an apparatus for gradatively driving a liquid crystal display panel having a liquid crystal layer held between a plurality of row electrodes and a plurality of column electrodes to define a matrix of pixels, according to pixel data composed of a multiple bits using both of pulse modulation and frame-rate modulation. The driving apparatus comprises first means for applying to the row electrodes a group of row signals represented by a set of orthogonal functions by group-sequential scanning at each selection period over one frame, and second means for successively carrying out dot product computation between the set of the orthogonal functions and a set of pixel data, and for applying to the column electrodes a plurality of column signals having voltage levels determined by results of the dot product computation at each selection period in synchronization with the group-sequential scanning. The second means comprises a frame memory, dot product computation means and driving means. The frame memory stores one frame of the pixel data which are split into each bit. The dot product computation means reads out a set of the stored pixel data in a split bit form from the frame memory so as to carry out the dot product computation to thereby generate a column signal component corresponding to each split bit. The driving means arranges a column signal component subjected to the pulse modulation and another column signal component subjected to the frame-rate modulation within one selection period to compose the column signal which is applied to the column electrode. Further, memory controlling means is provided for controlling writing of the pixel data into the frame memory such that one split bit subjected to the pulse modulation is written into the frame memory every frame, while another split bit subjected to the frame-rate modulation is written into the frame memory for only selected frames as specified by the frame-rate modulation.

The present invention is not limited to the multi-line selection mode, but may be generally applied to all of the driving apparatuses of the liquid crystal display panel, which requires writing of the pixel data into a frame memory. Namely, the invention generally covers an apparatus for gradatively driving a liquid crystal display panel having a liquid crystal layer held between a plurality of row electrodes and a plurality of column electrodes to define a matrix of pixels, according to a pixel data composed of a multiple of bits while applying frame-rate modulation to at least one bit of the pixel data. The apparatus basically comprises first means for applying a row signal to the row electrodes to carry out sequential scanning thereof, and second means for applying a column signal having a voltage level determined by the pixel data to the column electrodes in synchronization with the sequential scanning. The second means comprises a frame memory for storing one frame of the pixel data which are split into each bit, and driving means for reading out the stored pixel data in a split bit form and for processing the read out pixel data to form the column signal which is applied to the column electrodes. Further, the second means is provided with memory controlling means for controlling writing of the pixel data into the frame memory such that one split bit of the pixel data subjected to the frame-rate modulation is written into the frame memory only for selected frames as specified by the frame-rate modulation, while the remaining split bits are written into the frame memory every frame.

The inventive gradative driving apparatus carries out gray shading driving of the liquid crystal display panel according to the pixel data having the multi-bit structure while using the pulse modulation and the frame-rate modulation. For example, the pulse modulation is applied to a higher order bit and the frame-rate modulation is applied to a lower order bit, thereby lowering an overall system clock frequency of the gradative driving apparatus, which is advantageous in the circuit design. In such a case, with regard to the bit subjected to the frame-rate modulation, the writing of the pixel data is intermittently executed at a frame specified by the frame-rate modulation so as to save the frame memory capacity. For example, in case that the frame-rate of ½ gradation is applied to the lowest order bit, the pixel data is required for the computation of the column signal at every other frame. Consequently, the writing of the lowest bit of the pixel data is executed once for every of two frames so as to effectively reduce the capacity of the frame memory. As will be understood from above, the inventive data writing method is not limited to the multi-line selection mode, but may be applied to all types of gradative driving apparatus which execute the frame-rate modulation after storing the pixel data in the frame memory. For example, in the voltage averaging mode where the row electrodes are sequentially selected one by one, the invention can be used when driving the panel in divisional manner such that a screen is divided into upper and lower sections, because such a driving mode requires a frame memory.

BRIEF DESCRIPTION OF THE DRAWINGS

FIG. 3 is a table diagram illustrating gray shading operation of the driving apparatus shown in FIG. 1.

DETAILED DESCRIPTION OF THE INVENTION

Figure 1:
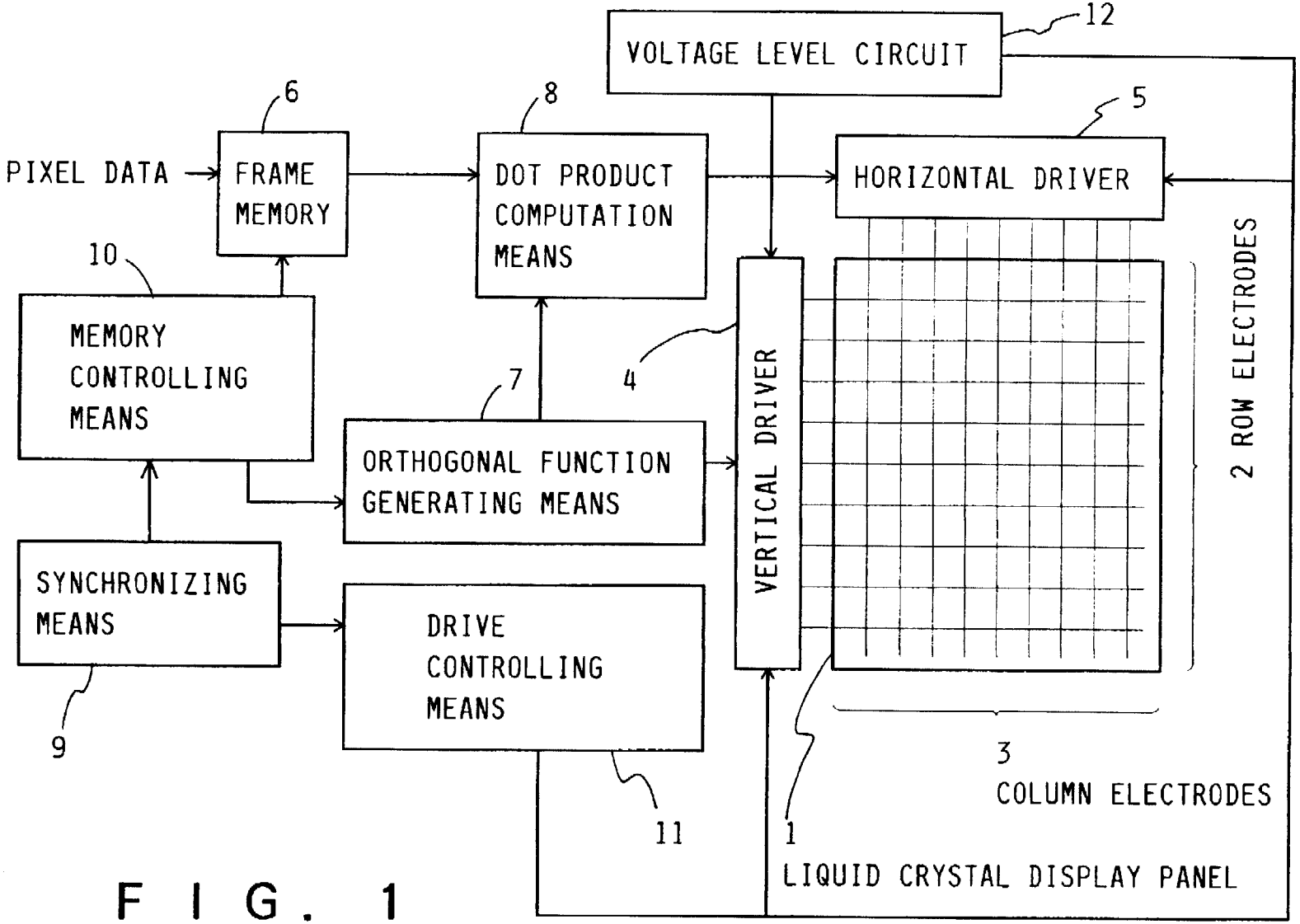
FIG. 1 is a block diagram showing a structural example of a gradative driving apparatus of a liquid crystal display panel, according to the invention.

Hereinafter, preferred embodiments of the invention will be described in detail with reference to the drawings. FIG. 1 is a schematic block diagram showing a gradative driving apparatus of a liquid crystal display panel according to the invention. As shown in the figure, the inventive gradative driving apparatus is connected to a liquid crystal display panel 1 of a simple matrix type. This liquid crystal display panel 1 has a flat panel structure where a liquid crystal layer is interposed between a plurality of row electrodes 2 and a plurality of column electrodes 3. The liquid crystal layer may be composed of STN liquid crystal. The present apparatus gradatively drives the liquid crystal display panel 1 according to pixel data having a multi-bit form while using the pulse modulation and the frame-rate modulation.

The gradative driving apparatus is provided with a vertical driver 4 connected to the row electrodes 2 to drive the same. Further, a horizontal driver 5 is connected to the column electrodes 3 to drive the same. The present apparatus further includes a frame memory 6, orthogonal function generating means 7 and dot product computation means 8. The frame memory 6 holds inputted pixel data for each frame. The pixel data indicate a density of pixels provided at intersections between the row electrodes 2 and the column electrodes 3. According to the invention, the pixel data have the multi-bit structure effective to determine a gradation level of the pixel density. In this connection, the frame memory 6 has a multiple of bit planes corresponding to bit units of the pixel data.

The orthogonal function generating means 7 generates a set of orthogonal functions which are Orthogonal to each other, and feeds these functions in a suitable combination pattern to the vertical driver 4. The vertical driver 4 applies to the row electrodes 2 a set of row signals represented by the orthogonal functions each selection period by group-sequential scanning. Consequently, the orthogonal function generating means 7 and the vertical driver 4 constitute the above-mentioned first means.

The gradative driving apparatus has second means comprised of dot product computation means 8 and a voltage level circuit 12 in addition to the frame memory 6 and the horizontal driver 5. The second means successively executes dot product computation between a set of the orthogonal functions and a set of the pixel data, and applies to the column electrodes 3 column signals having voltage levels determined by results of the dot product computation at each selection period in synchronization with the group-sequential scanning. In detail, the dot product computation means 8 reads out the set of the pixel data in the split bit form from the frame memory 6, and executes the dot product computation to produce a column signal component corresponding to one split bit. The horizontal driver 5 serially arranges a multiple of the column signal components subjected to either of the pulse modulation and the frame-rate modulation within one selection period to compose the column signal which is applied to the column electrodes 3. The voltage level circuit 12 provides voltage levels needed for producing the column signals. Further, the voltage level circuit 12 provides predetermined voltage levels to the vertical driver 4. The vertical driver 4 suitably selects the voltage levels according to the orthogonal functions to form the row signals which are applied to the row electrodes 2.

The present gradative driving apparatus has memory controlling means 10 as a characterizing element. This memory controlling means 10 carries out writing control of the pixel data into the frame memory 6. Namely, bits subjected to the pulse modulation are written into the frame memory at every frame period, while other bits subjected to the frame-rate modulation are written into the frame memory only at selected frame periods specified by the frame-rate. The apparatus includes a synchronizing circuit 9 and drive controlling means 11 in addition to the memory controlling means 10. The synchronizing circuit 9 synchronizes a reading timing of the pixel data from the frame memory 6 with a signal transfer timing from the orthogonal function generating means 7. The group sequential scanning is repeated several times within one frame to obtain a desired picture. The synchronizing circuit 9 also executes timing control of the memory controlling means 10. As described before, the memory controlling means 10 controls writing/reading of the pixel data with respect to the frame memory 6 for the split bit planes. The drive controlling means 11 operates under the control by the synchronizing circuit 9 to feed a clock signal to the vertical driver 4 and the horizontal driver 5.

As described before, the frame memory 6 stores the pixel data composed of multiple bits in the separate bit planes in order to achieve the gray shading by the pulse modulation and the frame-rate modulation. The dot product computation means 8 splits the set of the pixel data into each of its respective bit units, which is then subjected to the dot product computation with the set of the orthogonal functions so as to produce the corresponding column signal component. The horizontal driver 5 sequentially arranges the column signal components from higher order bits assigned with wider pulses to lower order bits assigned with narrower pulses within one selection period so as to form the column signal, which is then applied to the column electrode 3. At this time, a column signal component of the high order bit is subjected to the pulse modulation, while another column signal component of the low order bit is subjected to the frame-rate modulation.

Figure 2:
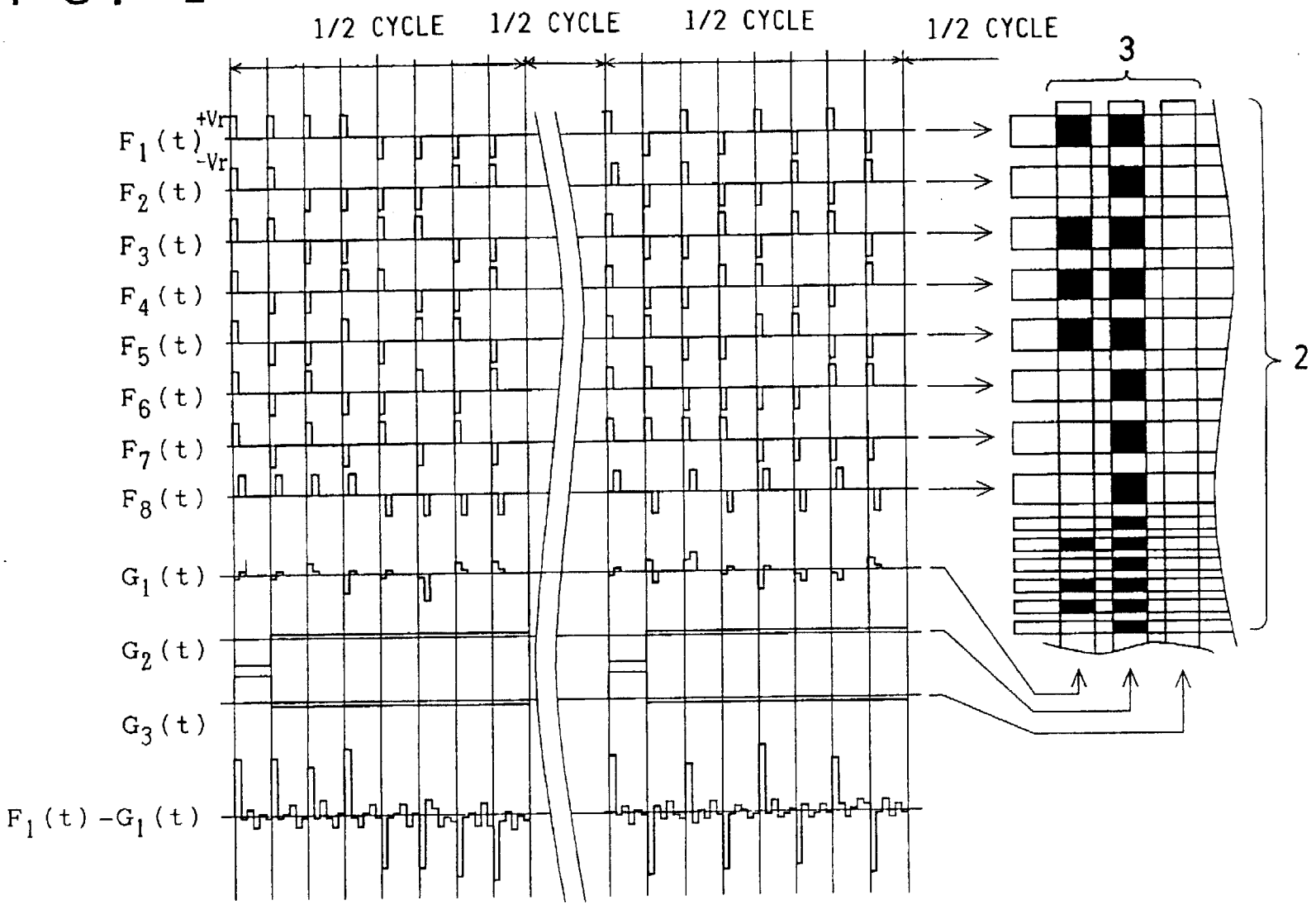
FIG. 2 is a timing chart illustrating multi-line selection operation of the driving apparatus shown in FIG. 1.

Hereinafter, operation of the gradative driving apparatus shown in FIG. 1 is described in detail. First, the detailed description is given for the multiple-line selection method where seven lines of the row electrodes are concurrently selected, for example. FIG. 2 is a waveform diagram of the seven-line selection driving. Row signals $F_1(+)$–$F_8(+)$ are applied to corresponding row electrodes, while column signals $G_1(+)$–$G_3(+)$ are applied to respective column electrodes. The row signal F is formed according to Walsh function which is the complete orthonormal function in (0,1), where "0" indicates –Vr and "1" indicates +Vr while $V_0$ is set in the non-selection period. Further, the voltage level $V_0$ of the non-selection period is set to 0 V. Upper seven lines of the row electrodes from top are selected as one group so that the group-sequential scanning is conducted downward. The scanning is repeated eight times to complete a first half cycle which corresponds to one period of the Walsh function set. In a next period, a second half cycle is executed while the polarity of the signal is inverted so as to eliminate a DC component. In a subsequent period, the combination pattern of the orthogonal function set is laterally shifted to form the row signals, which are applied to the row electrodes 2. The lateral shift may not be effected, if desired.

On the other hand, the column signal applied to each column electrode is obtained by the dot product computation of the pixel data $I_{ij}$ (i denotes a row number of the matrix, and j denotes a column number of the matrix). Provided that the pixel data is not the multi-bit form but the single-bit form, $I_{ij}=-1$ is set for a turned-on pixel and $I_{ij}=+1$ is set for a turned-off pixel. In such a case, the column signal $G_j(+)$ applied to each column electrode is determined by executing the following dot product computation:

$$G_j(t)=\frac{1}{\sqrt{N}}\sum_{i=1}^{N} I_{ij}\times F_i(t) \qquad \text{[Equation]}$$

In the computation, the row signal has a zero levels in the non-selection period, hence the summation in the above equation is effected only for the selected rows. Accordingly, in the seven-line selection mode, the column signal may have eight voltage level. Namely, the column signal requires voltage levels identical to the number of the selected lines plus one. These voltage levels are supplied from the voltage level circuit 12 as shown in FIG. 1.

The above dot product computation is applied to the pixel data of the single-bit form which does not present the gray shading. In the gradation display according to the invention, the pixel data has the multi-bit structure. In such a case, the dot product computation is conducted as follows. Referring to FIG. 3, the pixel data of a three-bit form is inputted to present a gray shaded picture of eight gradation levels. As shown in FIG. 3, the pixel data has a second bit of a high order, a first bit of an intermediate order and a zero-th bit of a low order. Each bit takes a binary value of "0" or "1". If the three bits all have the value "0", the lowest, or zero-th gradation level is set. If the three bits have all the value "1", the highest or seventh gradation level is set. Desired gray levels can be obtained according to the value of each bit. The dot product computation is conducted with the pixel data of the three-bit form such that the pixel data is split into each bit unit. Namely, the dot product computation is first executed between the set of the second order bits and the set of the orthogonal functions to produce a column signal component corresponding to the high order bit. Next, a similar dot product computation is executed between the set of the first order bits and the same set of the orthogonal functions to produce another column signal component corresponding to the middle order bit. Lastly, a similar dot product computation is executed between the set of the zero-th order bits and the same set of the orthogonal functions to produce a further column signal component corresponding to the low order bit.

Figure 4:
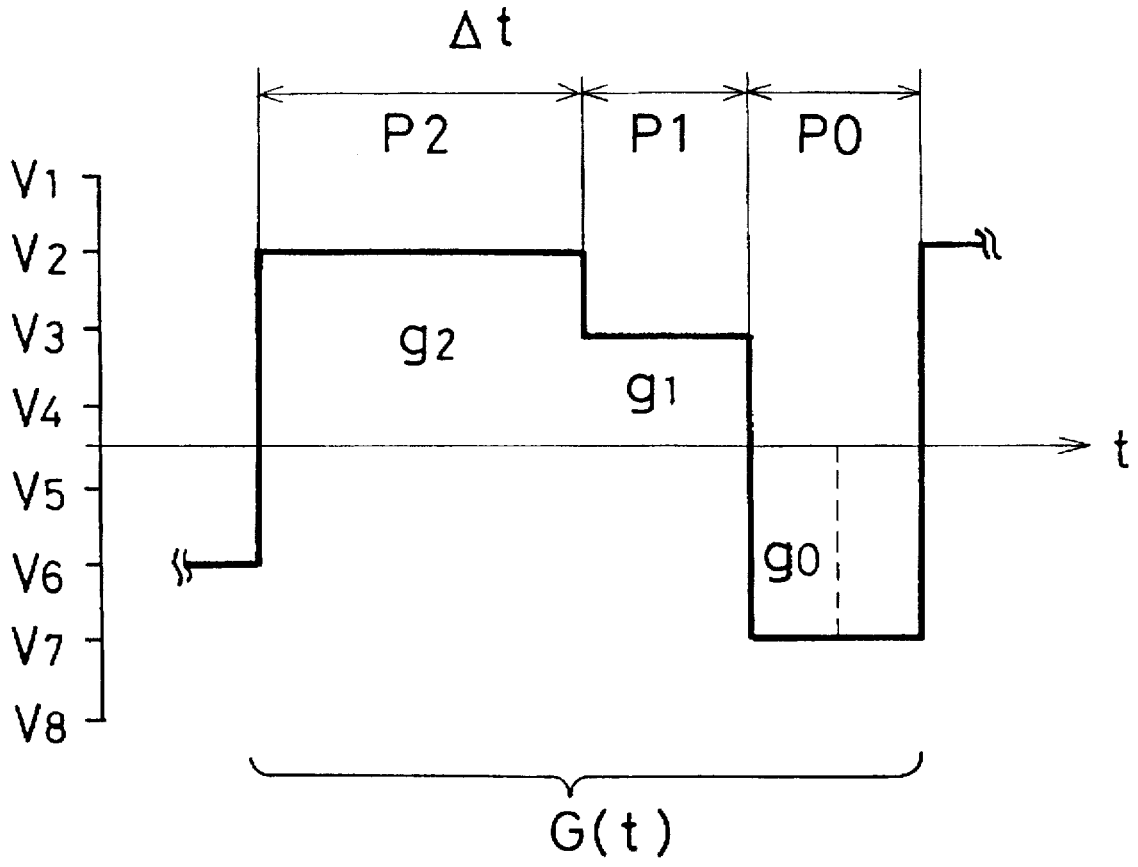
FIG. 4 is a waveform diagram illustrating the gray shading operation.

FIG. 4 exemplifies a column signal composed of a serial arrangement of the column signal components. In the FIG. 4 graph, the horizontal axis denotes a time t, and the vertical axis denotes a voltage level of the column signal G(t). The column signal. G(t) takes eight voltage levels $V_1$–$V_8$ according to the results of the dot product computation. The column signal G(t) includes the three column signal components g2, g1 and g0 corresponding to the three bits contained in the pixel data within one selection period Δt. The first component g2 is obtained by the dot product computation for the set of the second bits corresponding to the high order. The next component g1 corresponds to the intermediate order. The last component g0 corresponds to the low order.

In this embodiment, the pulse modulation is applied to the high and middle orders while the frame-rate modulation is applied to the low order. The component g2 corresponding to the high order has a widest pulse width P2. The next component g1 has a pulse width P1 which is a half of P2. With regard to the column signal component g0 of the low order, its pulse width P0 may be set half of P1 if the pulse modulation is applied. However, actually the present embodiment adopts the frame-rate modulation so that the component g0 has the pulse width P0 identical to the pulse width P1 of the middle component g1. By such an arrangement, the column signal component g0 is alternately outputted at every other frame so that the pulse width thereof is set half of the pulse width P0 by averaging through the frames to thereby realize the ½ gradation. By such a manner, the frame-rate modulation is applied to the low order bit to avoid an excessively narrow pulse width to thereby remove a heavy burden on the circuit design. The invention is not limited to the described embodiment, but the frame-rate modulation can be freely applied to a desired order of bit. Further, ¼ gradation can be realized instead of the ½ gradation. In such a case, one frame is thinned out from every four frames.

Figure 5:
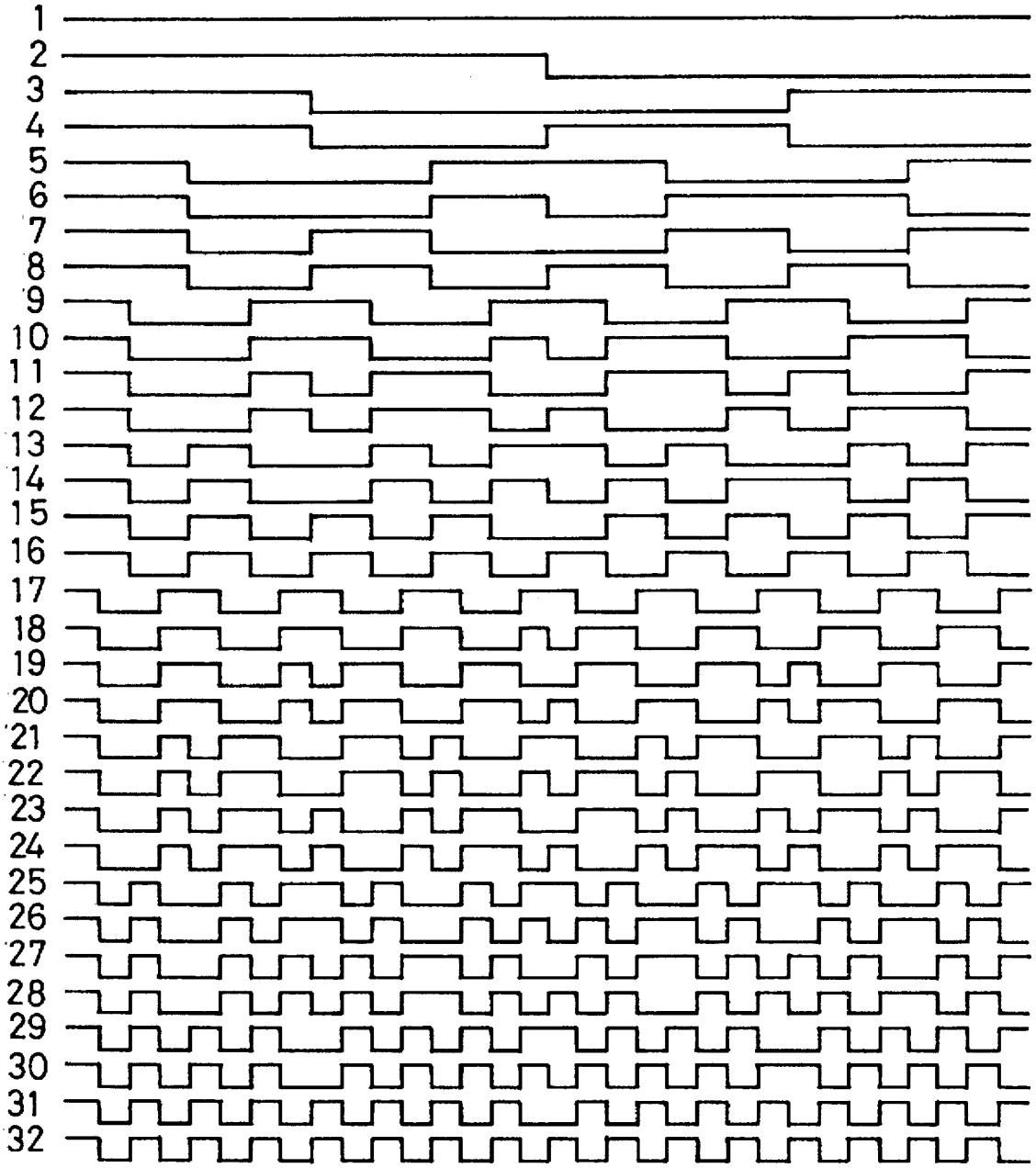
FIG. 5 is a waveform diagram showing an example of orthogonal functions used in the driving apparatus of FIG. 1.

FIG. 5 is a waveform diagram showing the Walsh functions. In case of the seven-line selection drive, for example the second through eighth Walsh functions are selected as a set to form the row signals. As understood by comparison between FIGS. 2 and 5, the row signal $F_1(t)$ corresponds to the second Walsh function next to the top. The second Walsh function has a high level at a first half of one period, and turns to low level at a second half of the one period. Accordingly, the row signal $F_1(t)$ is composed of a sequence of pulses arranged (1, 1, 1, 1, 0, 0, 0, 0). In a similar manner, the row signal $F_2(t)$ corresponds to the third Walsh function, and has a pulse train arrangement of (1, 1, 0, 0, 0, 0, 1, 1). Further, the row signal $F_3(t)$ corresponds to the fourth Walsh function, and has a pulse train arrangement of (1, 1, 0, 0, 1, 1, 0, 0). As will be understood from the description, the set of the row signals applied to one group of the row electrodes is represented by a suitable combination pattern based on the orthogonal relation. In the case of FIG. 2, the set of the row signals $F_8(t)$–$F_{14}(t)$ having the same combination pattern is applied to a next group of the row electrodes. In a similar manner, the set of the row signals according to the same combination pattern is applied to the third and subsequent groups of the row electrodes.

Figure 6:
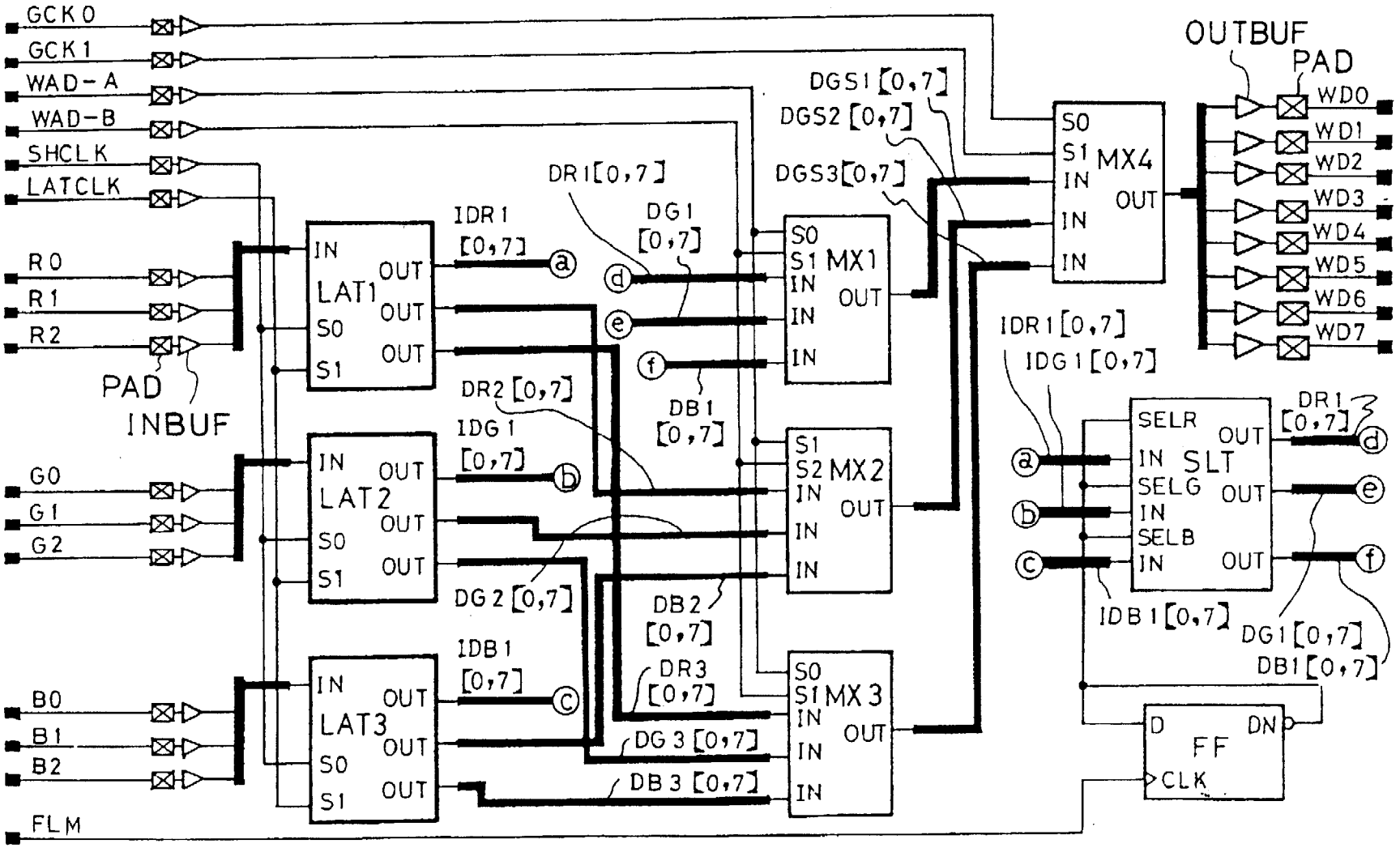
FIG. 6 is a block diagram showing a detailed structure of memory controlling means contained in the driving apparatus shown in FIG. 1.

Next, referring to FIG. 6, detailed description is given for a practical construction of the memory controlling means 10 shown in FIG. 1. The circuit construction of FIG. 6 includes three latch circuit LAT1, LAT2 and LAT 3, four multiplexers MX1, MX2, MX3 and MX4, one selector SLT, and one flipflop FF.

The inputted pixel data covers three primary color elements, and has the three-bit form. The pixel data of the red color element is composed of a low bit R0, a middle bit R1 and a high bit R2. R0 is subjected to the frame-rate modulation, while R1 and R2 are subjected to the pulse modulation. In similar manner, the pixel data of the green color element is composed of three bits G0, G1 and G2, and the pixel data of the blue color element is composed of three bits B0, B1 and B2. These pixel data are inputted bit by bit through IC pads PAD and input buffers INBUF. Further, various timing signals are fed from the pads and the input buffers for controlling operation. These timing signals include a signal FLM which changes between the low level and the high level at every frame. Further, a pair of timing signals SHCK and LATCLK are used for operation control of the latch circuits LAT1, LAT2 and LAT3. Moreover, timing signals WAD-A and WAD-B are used for operation control of the multiplexers MX1, MX2 and MX3. Still further, a pair of timing signals GCK0 and GCK1 are used for operation control of the multiplexer MX4.

The description will continue for operation in conjunction with FIG. 6. LAT1 latches R0, R1 and R2 of every eight bits, respectively. Eight bits of R0 are successively outputted as IDR1. Eight bits of R1 are successively outputted as DR2. Eight bits of R2 are successively outputted as DR3. In a similar manner, LAT2 latches G0, G1 and G2, of every eight bits, respectively. Eight bits of G0 are successively outputted as IDG1, eight bits of G1 are successively outputted as DG2, and eight bits of G2 are successively outputted as DG3. Similarly, LAT3 latches B0, B1 and B2, every eight bits, respectively. Eight bits of B0 are successively outputted as IDB1, eight bits of B1 are successively outputted as DB2, and eight bits of B2 are successively outputted as DB3.

The multiplexers MX1, MX2 and MX3 rearrange the eight bits of the pixel data into a sequence of RGBRGB, . . . corresponding to an RGB arrangement of the column electrodes. The multiplexer MX1 carries out the RGB rearrangement for the low order bit, the multiplexer MX2 carries out the RGB rearrangement for the middle order bit, and the multiplexer MX3 carries out the RGB rearrangement for the high order bit. In this embodiment, DR2, DG2 and DB2 of the middle order are inputted from respective LAT1, LAT2 and LAT 3 into MX2 as they are. Further, DR3, DG3 and DB3 of the high order are also inputted into MX3 as they are. On the other hand, as shown in the figure, IDR1, IDG1 and IDB1 of the low order are changed to DR1, DG1 and DB1, respectively, by means of the selector SLT, which are then inputted into the corresponding multiplexer MX1. The selector SLT is controlled by the flipflop FF. The FF converts the signal FLM which inverts every frame into a signal SEL which inverts every two frames. The signal SEL is inputted into a select terminal of the selector SLT. The selector SLT operates in response to SEL to sample IDR1, IDG1 and IDB1 every other frame so as to provide DR1, DG1 and DB1, respectively. By this, the selection is conducted at writing stage for the low order bits subjected to the frame-rate modulation, thereby saving an effective capacity of the frame memory.

By such a manner, MX1 effects the rearrangement of the low order bit in the order of RGB to produce a data DGS1, which is fed to the multiplexer MX4. Similarly, MX2 effects the rearrangement of the middle order bit in the order of RGB to produce a data DGS2, which is also fed to MX4. Further, MX3 effects the rearrangement of the high order bit in the order RGB to produce a data DGS3, which is also fed to MX4. MX4 is operatively controlled by the pair of the timing signals GCK0 and GCK1 for rearranging the inputted data in the order of high, middle and low bits, results of which are outputted through output buffers OUTBUF and pads PAD. Namely, the data rearranged in the order of the high, middle and low bits are outputted externally as WD0, WD1, WD2, WD3, WD4, WD5, WD6 and WD7.

Figure 7:
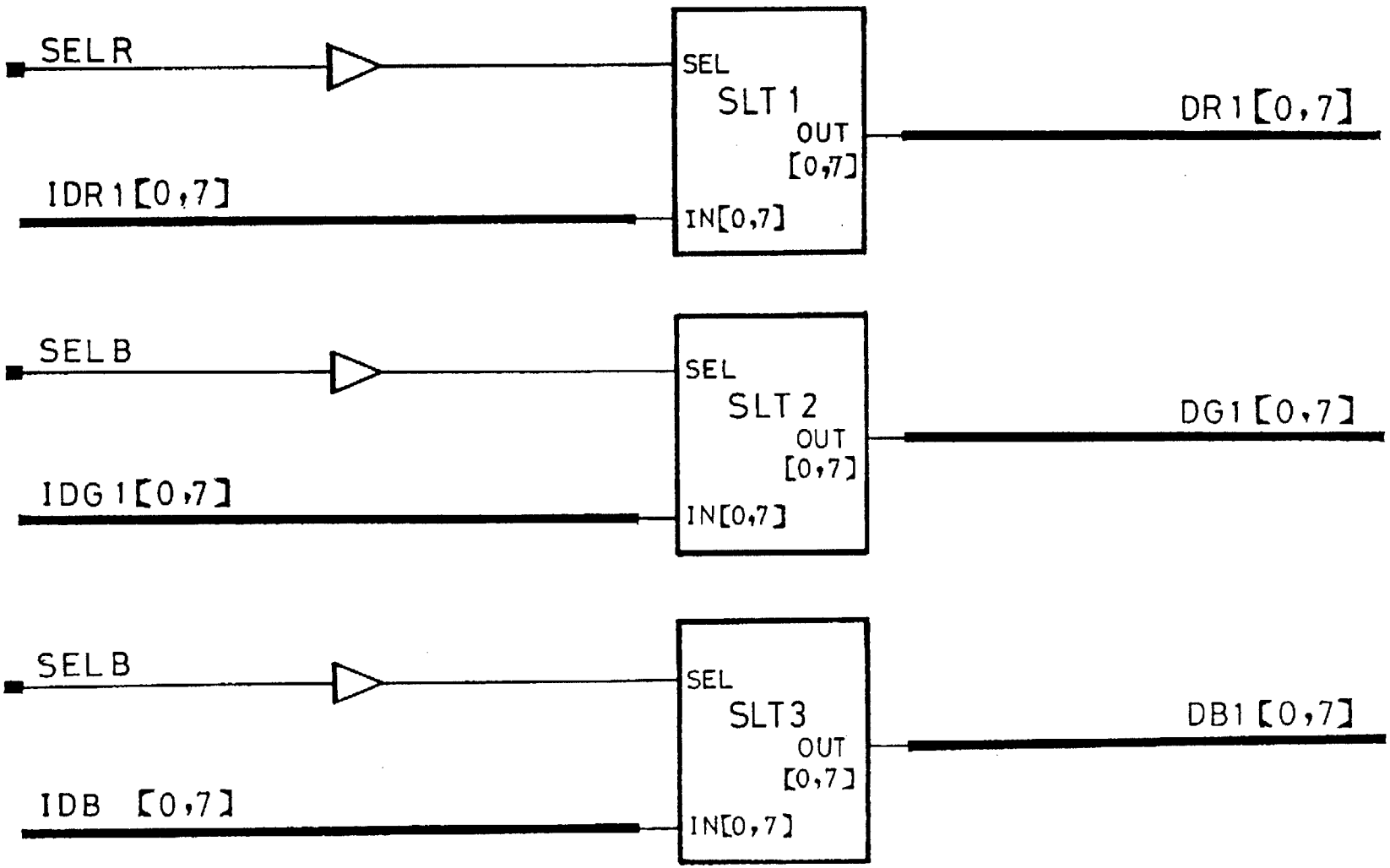
FIG. 7 is a block diagram showing a detailed structure of a selector contained in the FIG. 6 circuit.

FIG. 7 is a block diagram showing a structural example of the selector SLT shown in FIG. 6. As shown in the figure, the selector SLT is composed of selection units SLT1, SLT2 and SLT3, which are provided correspondingly to IDR1, IDG1 and IDB1, respectively.

Figure 8:
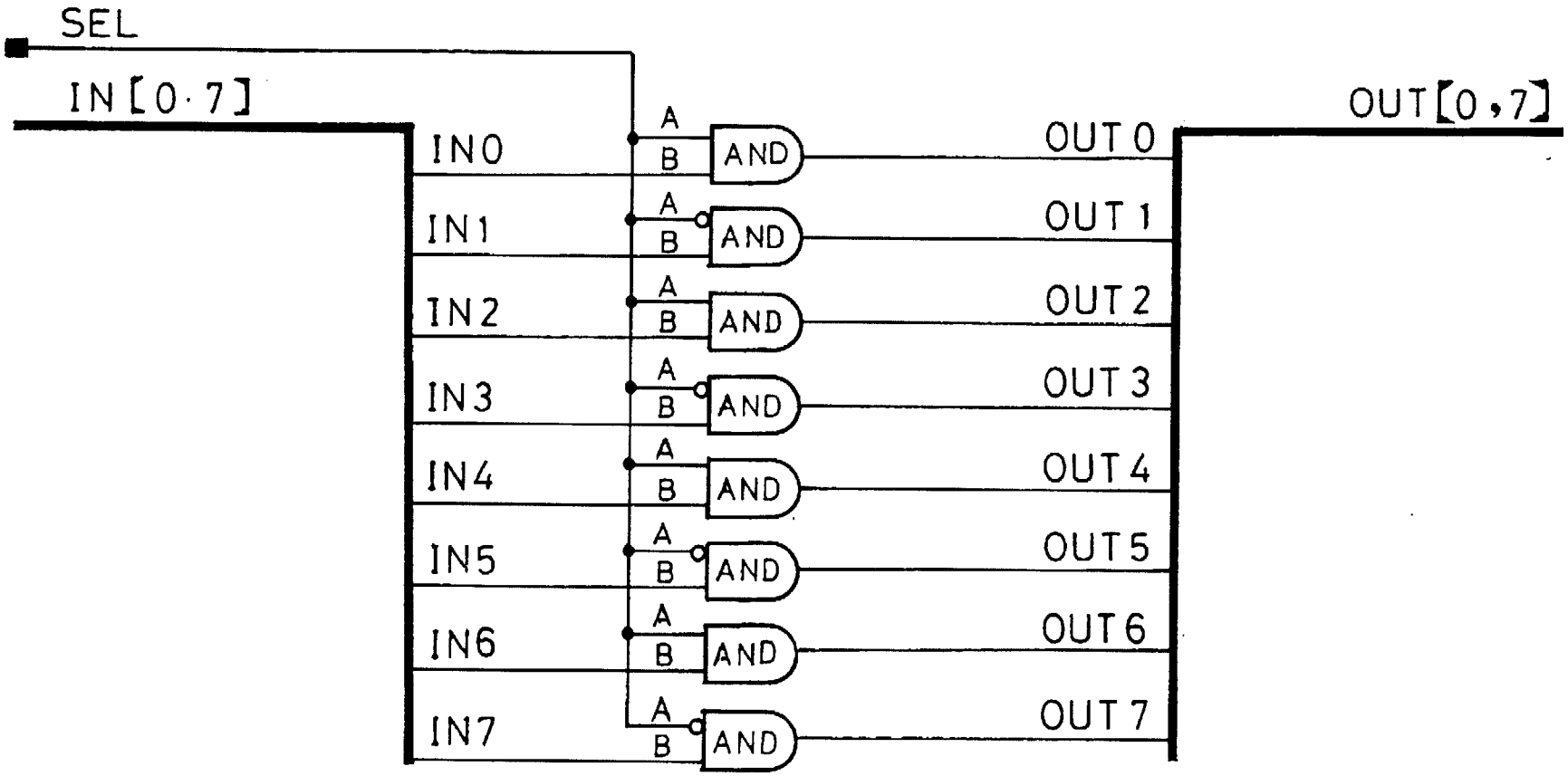
FIG. 8 is a circuit diagram showing a detailed structure of a selection unit shown in FIG. 7.

Lastly, FIG. 8 is a circuit diagram showing a structural example of the selection unit shown in FIG. 7. In the figure, eight and-gate elements AND are provided corresponding to eight bits of input data IN0–IN7. Each AND gate has one input terminal A for receiving the selection signal SEL which changes between the high level and the low level every two frames, and another input terminal B for receiving the corresponding input data IN. An odd Number of AND gate receive a positive input at the terminal A, while an even number of AND gate receive a negative input at the terminal A. Accordingly, an odd number of the input data IN0, IN2, IN4 and IN6 pass the corresponding at first and second frames when SEL is held at the high level. On the other hand, an even number of the input data IN1, IN3, IN5 and IN7 pass the corresponding ANDs at the third frame when SEL is held at the low level. By such a manner, in the present embodiment, a half of the pixel data of the low bit order is selected every two frames. Stated otherwise, the frame-rate modulation is carried out alternately between odd and even lines of the column electrodes, thereby averaging variation in the applied voltage over the frames.

As described above, according to the invention, the bit data subjected to the frame-rate modulation is written into the frame memory at a frame period which is specified by the frame-rate modulation, while the remaining bit data are written into the frame memory at every frame period, thereby advantageously saving the frame memory capacity.

What is claimed is:

1. An apparatus for gradatively driving a liquid crystal display having a liquid crystal panel comprising a liquid crystal material layer disposed between a plurality of row electrodes and a plurality of column electrodes to define a matrix of pixels, according to pixel data composed of a plurality of bits using pulse modulation and frame-rate modulation, the apparatus comprising: first means for applying to a plurality of row electrodes a group of row signals represented by a set of orthogonal functions by group-sequential scanning at a plurality of selection periods within one frame interval; and second means for successively carrying out dot product computation between the set of orthogonal functions and a set of pixel data, and for applying to the column electrodes a plurality of column signals having voltage levels determined by results of the dot product computation at each selection period in synchronization with the group-sequential scanning; wherein the second means comprises a frame memory for storing pixel data for one frame which are split into individual bits, dot product computation means for reading out a set of the stored pixel data in a split bit form from the frame memory so as to carry out the dot product computation to thereby generate a column signal component corresponding to each split bit, driving means for arranging a column signal component subjected to pulse modulation and another column signal component subjected to frame-rate modulation within one selection period to compose the column signal which is applied to the column electrode, and memory controlling means for controlling writing of the pixel data into the frame memory such that one split bit subjected to pulse modulation is written into the frame memory every frame, while another split bit subjected to the frame-rate modulation is written into the frame memory only at selected frames specified in accordance with the frame-rate modulation rate.

2. An apparatus for gradatively driving a liquid crystal display panel having a liquid crystal panel comprising a liquid crystal material layer disposed between a plurality of row electrodes and a plurality of column electrodes to define a matrix of pixels, according to pixel data composed of a multiple of bits, while applying frame-rate modulation to at least one bit of the pixel data, the apparatus comprising: first means for sequentially applying a row signal to at least one row electrode to carry out sequential scanning of the row electrodes; and second means for applying a column signal having a voltage level determined by the pixel data to the column electrodes in synchronization with the sequential scanning; wherein the second means comprises a frame memory for storing pixel data for one frame which are split into individual bits, driving means for reading out the stored pixel data in a split bit form and for processing the read out pixel data to form the column signal which is applied to the column electrodes, and memory controlling means for controlling writing of the pixel data into the frame memory such that one split bit of the pixel data subjected to the frame-rate modulation is written into the frame memory only at selected frames specified by the frame-rate modulation rate, while the remaining split bits are written into the frame memory at every frame.

* * * * *